US008544488B2

(12) United States Patent
Lin

(10) Patent No.: US 8,544,488 B2
(45) Date of Patent: Oct. 1, 2013

(54) COLLAPSIBLE CANOPY

(76) Inventor: Justin Chun-Te Lin, Taipei (TW)

( * ) Notice: Subject to any disclaimer, the term of this patent is extended or adjusted under 35 U.S.C. 154(b) by 35 days.

(21) Appl. No.: 13/197,152

(22) Filed: Aug. 3, 2011

(65) Prior Publication Data

US 2013/0032186 A1 Feb. 7, 2013

(51) Int. Cl.
*E04H 15/34* (2006.01)

(52) U.S. Cl.
USPC ..... 135/96; 135/158; 135/160

(58) Field of Classification Search
USPC ..... 135/122, 124, 129, 137, 157, 158, 135/160; 52/64
See application file for complete search history.

(56) References Cited

U.S. PATENT DOCUMENTS

| | | | | |
|---|---|---|---|---|
| 2,817,344 | A * | 12/1957 | Teeter | 135/129 |
| 4,827,957 | A * | 5/1989 | Chang | 135/121 |
| 4,844,109 | A * | 7/1989 | Navarro | 135/129 |
| 5,437,298 | A * | 8/1995 | Lin | 135/117 |
| 5,809,701 | A * | 9/1998 | Vollebregt | 52/13 |
| 6,343,613 | B1 * | 2/2002 | Yasutomi | 135/88.01 |
| 6,497,074 | B2 * | 12/2002 | Nelson | 52/2.23 |
| 6,952,900 | B2 * | 10/2005 | Leurent | 52/86 |
| 7,127,861 | B2 * | 10/2006 | Arbel et al. | 52/639 |
| 7,234,303 | B2 * | 6/2007 | Thiagarajan et al. | 60/641.8 |
| 7,523,584 | B2 * | 4/2009 | Voehringer | 47/29.1 |
| 7,748,137 | B2 * | 7/2010 | Wang | 34/396 |
| 2009/0217617 | A1 * | 9/2009 | Kennedy et al. | 52/781 |
| 2010/0000596 | A1 * | 1/2010 | Mackler | 136/246 |

* cited by examiner

*Primary Examiner* — Noah Chandler Hawk
(74) *Attorney, Agent, or Firm* — Muncy, Geissler, Olds & Lowe, PLLC

(57) ABSTRACT

A collapsible canopy that is expandable during rain fall. The canopy includes a frame, a propulsive mechanism and a shelter. The frame has a stationary side and a movable side. The stationary side is fixed to ground. The movable side is opposite to the stationary side and is configured to move forward and backward in a predetermined path, which expands the coverage of the collapsible canopy. The propulsive mechanism drives the movable side to expand the frame. The shelter is expandable and collapsibly connected to the frame, wherein the shelter forms a collective area to provide sheltering from exterior weather conditions and guides the fluid out when the shelter is expanded and driven by the movable side of the frame.

12 Claims, 5 Drawing Sheets

COLLAPSIBLE CANOPY

FIELD OF THE INVENTION

Embodiments relate to a canopy, especially to a collapsible canopy that is expandable during rain fall.

BACKGROUND

A typical canopy includes a canopy cover supported on a canopy frame (e.g. steel metal frame.) Canopy covers are typically composed of a fabric material, normally waterproof material. The canopy cover hangs over the canopy frame to provide shelter from exterior weather conditions or debris such as sun, rain or snow.

However, the canopy cover is constructed in a solid surface because of the waterproof requirement. When it rains on the cover, pools of rain water often gather on various portions of the cover. Such pools often cause the cover to sag that not only form an unsightly or lumpy appearance for the cover, but also exert undesirable forces against the canopy cover. Too much undesirable forces may tear or damage the cover.

Accordingly, a need exists for a canopy cover that allows for guiding of rain water from the canopy cover within a path, which diminishes any undesirable forces of water pools.

SOME EXEMPLARY EMBODIMENTS

These and other needs are addressed by the exemplary embodiments, in which one approach provided for a collapsible canopy that is expanded during rain fall to guide fluid (i.e., rain water) for diminishing any undesirable forces of water pools.

Another approach provided for a collapsible canopy that is flexible, expandable, portable, easy assembly, low maintenance and economic affordable for protecting underneath plants from damages of natural disasters and collecting rain water.

According to one aspect of an embodiment of the present invention, a canopy comprises a frame, a propulsive mechanism and a shelter. The frame has a stationary side and a movable side. The stationary side is fixed to ground. The movable side is opposite corresponded to the stationary side and is configured to move forward and backward in a predetermined path, which expands the coverage of the collapsible canopy. The propulsive mechanism drives the movable side to expand the frame. The shelter is expandable and collapsible connected to the frame, wherein the shelter forms a collective area to provide sheltering from exterior weather conditions and guides the fluid out when the shelter is expanded and driven by the movable side of the frame.

Still other aspects, features, and advantages of the exemplary embodiments are readily apparent from the following detailed description, simply by illustrating a number of particular embodiments and implementations, including the best mode contemplated for carrying out the exemplary embodiments. The exemplary embodiments are also capable of other and different embodiments, and their several details can be modified in various obvious respects, all without departing from the spirit and scope of the exemplary embodiments. Accordingly, the drawings and description are to be regarded as illustrative, and not as restrictive.

BRIEF DESCRIPTION OF THE DRAWINGS

The exemplary embodiments are illustrated by way of examples, and not by way of limitation, in the figures of the accompanying drawings in which like reference numerals refer to similar elements and in which.

DESCRIPTION OF THE PREFERRED EMBODIMENT

Figure 1:
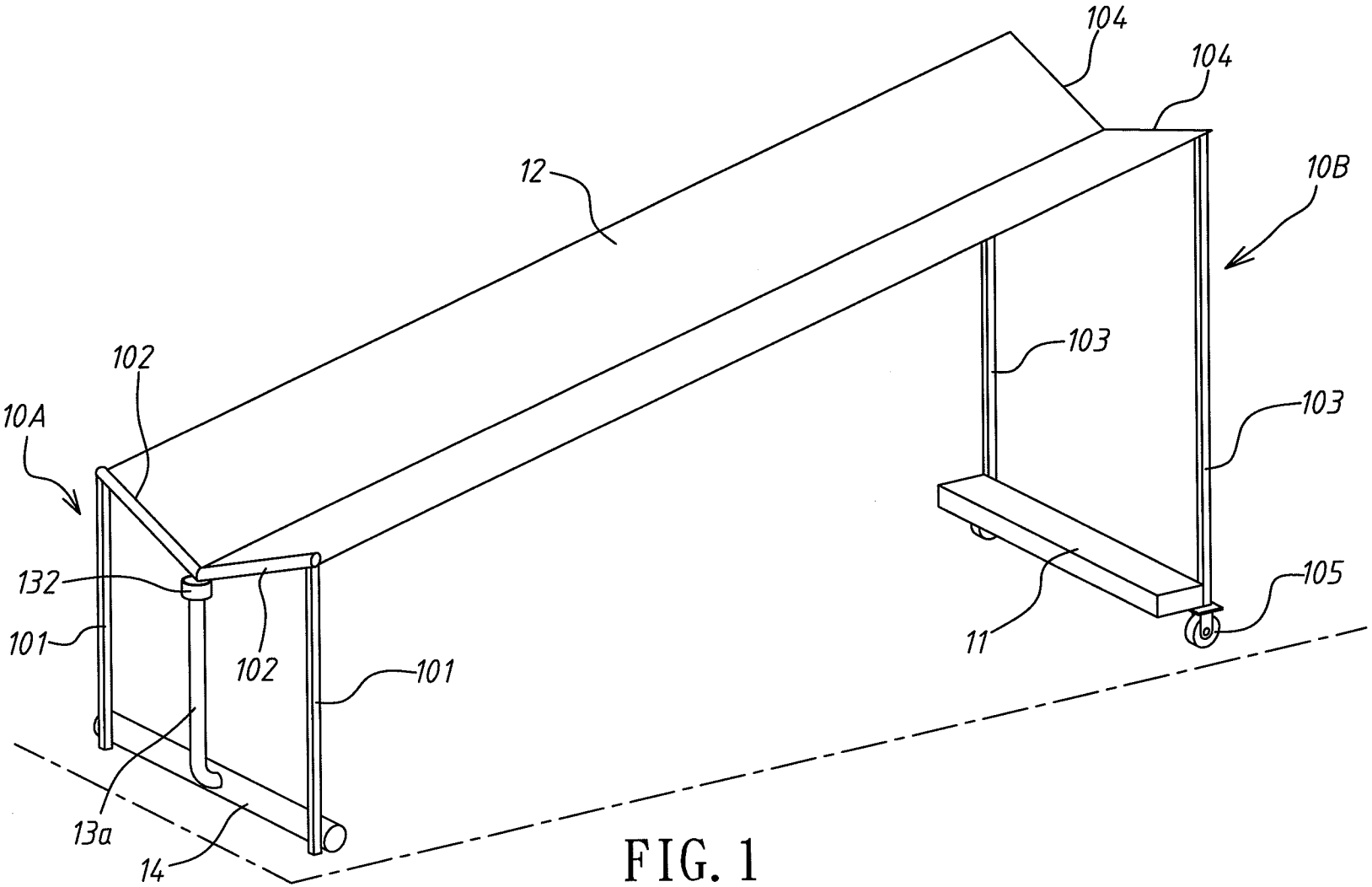
FIG. 1 is a diagram of the architecture of a canopy when shelter is expanded in accordance with an embodiment of the invention.
Figure 2A:
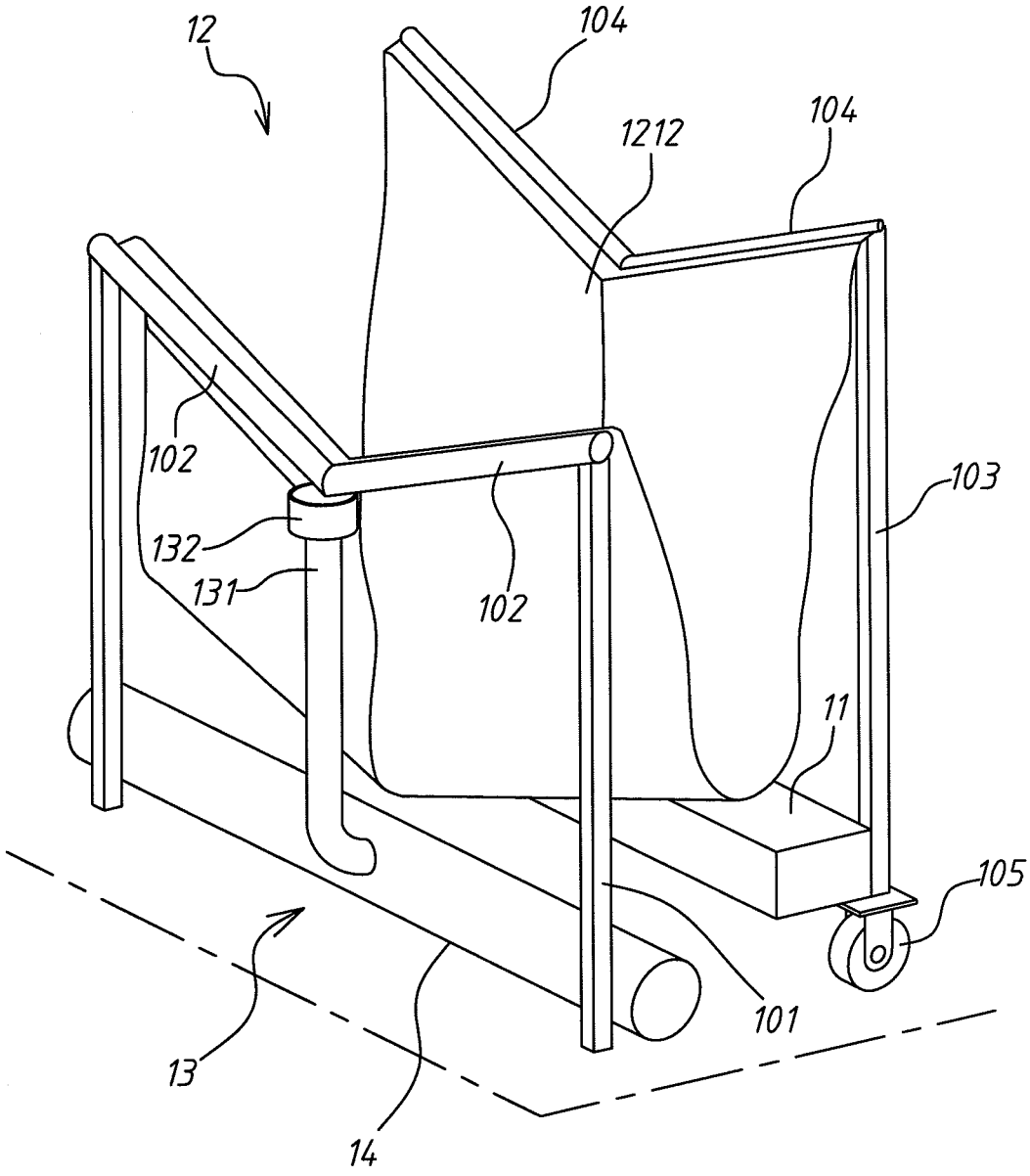
FIG. 2A is a diagram of the architecture of the canopy of FIG. 1, when shelter is collapsed.
Figure 2B:
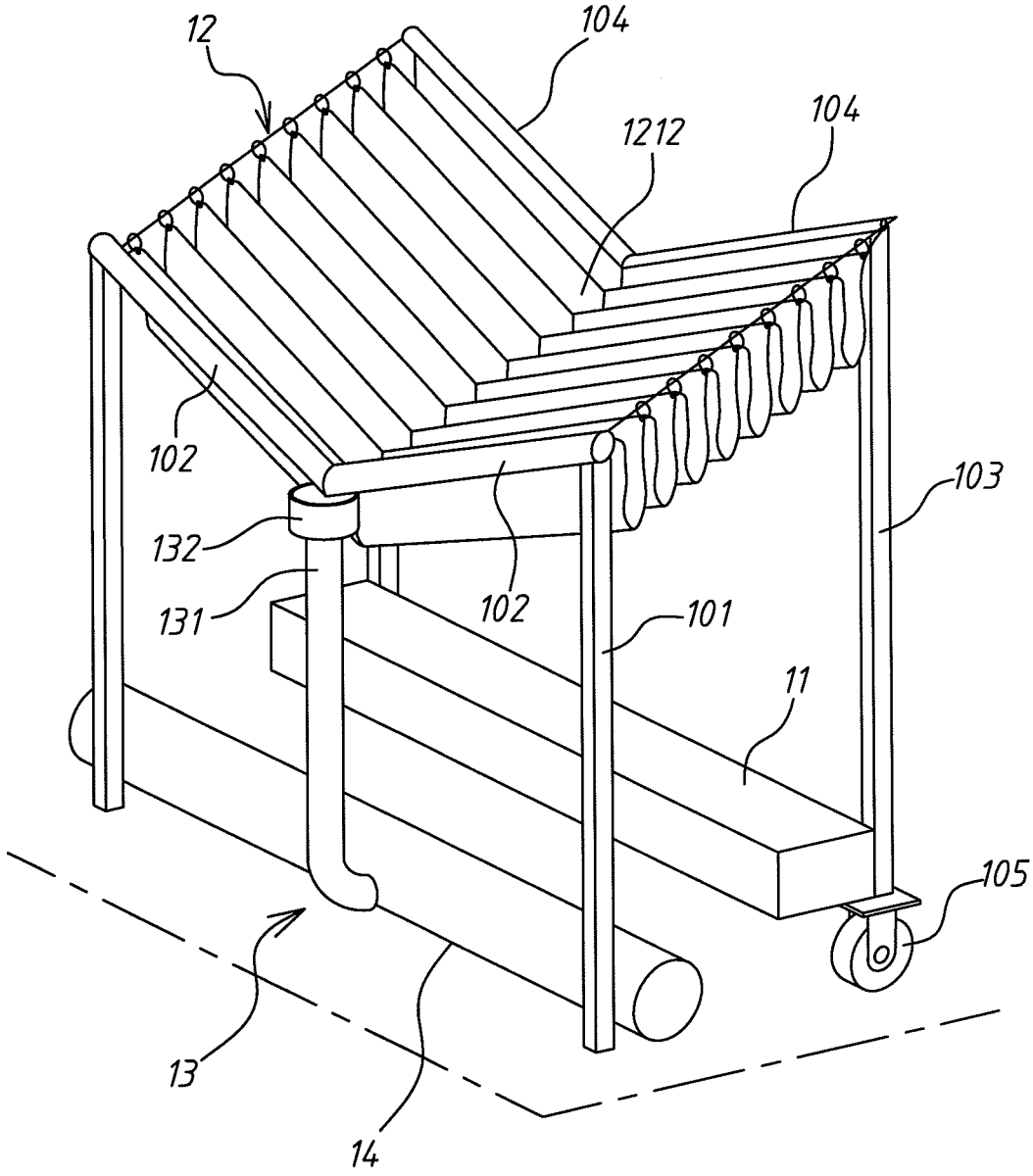
FIG. 2B is a diagram of another embodiment of the architecture of the canopy of the canopy of FIG. 1, when shelter is collapsed.

With reference to FIGS. 1, 2A and 2B, exemplary embodiments of the present invention is directed to a collapsible canopy, the collapsible canopy comprises a frame, a propulsive mechanism 11 and a shelter 12. The frame has a stationary side 10A and a movable side 10B. The stationary side 10A is formed by two rods 101 and two valley bars 102. Rods 101 may be fixed to ground. The valley bars 102 are connected to each other, and are supported by the rods 101. Each valley bars 102 has an upper end and a lower end. The upper end of the valley bar 102 connects to a top of the rod 101, and the lower end of the valley bar 102 connects to the other lower end of the other valley bar 102. In this manner, as shown in FIG. 1, the two connected valley bars 102 formed a valley (i.e., V shape) in a side view.

The movable side 10B is also formed by two rods 103 and two valley bars 104, and is opposite corresponded to the stationary side 10A. The rods 103 of the movable side 10A are detachable from ground and may connect to a corresponding mobile mechanism 105. In this example, the mobile mechanism 105 is a wheel. The movable side 10B of the frame is configured to move forward and backward in a predetermined path, which expands the coverage of the collapsible canopy. The predetermined path can be simply a track notched on ground. The valley bars 104 of the movable side 10B are connected to each other, and are supported by the rods 103. Each valley bars 104 has an upper end (not shown) and a lower end (not shown). The upper end of the valley bar 104 connects to a top of the corresponding rod 103, and the lower end of the valley bar 104 connects to the other lower end of the valley bar 104.

The propulsive mechanism 11 drives the movable side 10B to expand the frame and may be selectively located on the stationary side or the movable side. In this example, the propulsive mechanism 11 is mounted on the movable side 10B connected to the mobile mechanism 105 (i.e., the wheel), which is triggered by a user and drives the mobile mechanism 105. The propulsive mechanism 11 may be a manually-operated module or a motorized module, and thus the mobile mechanism 105 can be driven by the manually-operated module, or the motorized module. It is noted that those skilled in the art would recognize that the mobile mechanism 105 can selectively be driven by a manually-operated module operated by hand (e.g. hand gear or mechanical spring), a motorized module operated by electricity or both.

The shelter 12 is expandable and collapsible connected to the corresponding valley bars 102, 104 of the frame. When the shelter 12 is collapsed and stored at an end of the stationary side 10A of the frame, as shown in FIGS. 2A and 2B, allows the canopy to provide more open wide growth space and sufficient sunlight for plants or any other living creature. On the contrary, as shown in FIG. 1, the shelter 12 is expanded and driven by the movable side 10B of the frame. The expanded shelter 12 forms a collective area to provide shelter from exterior weather conditions or debris such as sun, rain or snow. As above mentioned, the movable side 10B of the frame is driven by the propulsive mechanism 11. Therefore, when rains, the canopy is able to unfold effectively and immediately, especially for a large ground area.

The shelter 12 may form a curtain-like configuration when expand or collapse between the stationary side 10A and the movable side 10B. As shown in FIG. 2B, the shelter 12 further comprises multiple grommets and is supported by a filament. The filament is connected between the stationary side 10A and the movable side 10B, and is inserted sequentially through each grommet. A person skilled in the art would recognize that the grommets can be secured connected at predetermined positions of the filament, or can be movable latitude that moves freely when the shelter 12 is expandable and collapsible connected to the corresponding valley bars 102, 104 of the frame.

Figure 3:
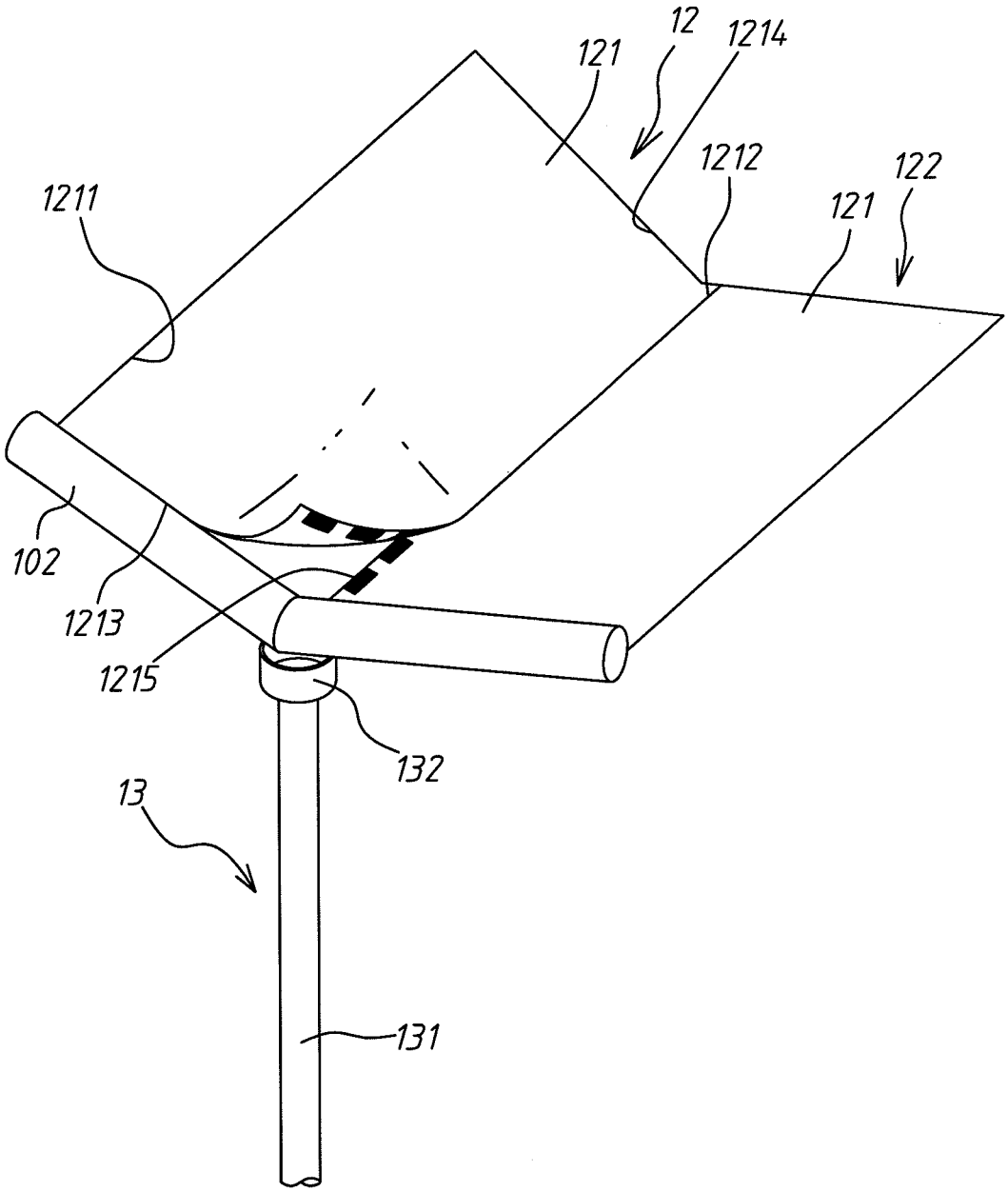
FIG. 3 is a partial diagram of a shelter structure in accordance with another embodiment of the invention.

According to one embodiment of the present invention, as shown in FIG. 3, the shelter 12 is formed by two segments 121 (e.g. waterproof sheets). Each segment 121 comprises a first edge 1213, a rear edge 1214, a first side edge 1211 and a second side edge 1212. The first edge 1213 is coupled to and supported by one of the valley bar 102 of the stationary side of the frame. The rear edge 1214 is connected to one of the valley bar 104 of the movable side of the frame. The second side edge 1212 is connected to the second side edge 1212 of the adjacent segment.

In addition, when the propulsive mechanism 11 is operated by electricity, the canopy may further comprise a battery module. The battery module provides power to the propulsive mechanism and may be disposed on or integrated with the propulsive mechanism. Further, the segments 121 of the shelter 12 may be a solar panel that converts sunlight to electricity, which charges the battery module.

As evident from FIG. 3, since the valley bars 102 connected in V shape, the two segments 121 of the shelter 12 forms two upper portions and a lower portion. The lower portion is formed as the second side edges 1212 of two connected segments 121 sank toward ground (i.e., downward). In this manner, the shelter 12 is able to guide the fluid (i.e., raindrop) flowing out the canopy from the upper portions to the lower portion. As such, the formation of unsightly and potentially harmful pools on the surface of the segment is reduced or eliminated.

The connections of the edges (i.e., the first edge 1213, the rear edge 1214, and the side edges 1211, 1212) between two separate segments 121 can be implemented by any suitable connecting assembly 1215, which may include one or more of, but not limited to using zipper, Velcro or hanger. It is apparent, however, to one skilled in the art that may use multiple abovementioned embodiments by connecting the first side edge of one canopy to the first side edge of another canopy so as to extend the coverage.

According to another embodiment of the present invention, the predetermined path is a slide assembly integrated with the mobile mechanism. The slide assembly is connected to the corresponding rods between the stationary side and the movable side. The mobile mechanism is a slide runner of the slide assembly, which is driven by the propulsive mechanism or hands. In one embodiment of the present invention, the propulsive mechanism is a motorized module mounted on the end of the stationary side of the frame. The propulsive mechanism drives the slide runner, the canopy unfolded as the slide runner extends from the slide assembly.

As shown in FIGS. 1, 2A, 2B and 3, the canopy further comprises a drain 13 disposed under a side of two connected second side edges 1212 where the fluid is flowing out. The drain 13 comprises a tube 131, a flange 132 and an optional strainer (not shown). The tube 131 has an inlet and an outlet, which may guide fluid out or into a guiding tube 14. The guiding tube 14 collects water from each corresponding drain 13 and guides fluid into an external water container (not shown). The flange 132 is fastened to the inlet of the tube 131. The strainer is disposed between the inlet of the tube and flange 132, and is used to filter the fallen leaves and dusts. Alternatively, the strainer may be disposed on the outlet of the tube 131.

In order to make the fluid flowing out more smoothly from the canopy, one embodiment of the present invention, the height of the movable side 10B of the frame is higher than the height of the stationary side 10A. In this way of the embodiment, the fluid on the surface of the shelter 12 may easily flow from the movable side 10B to the stationary side 10A then into the drain 13 for water collection.

Figure 4:
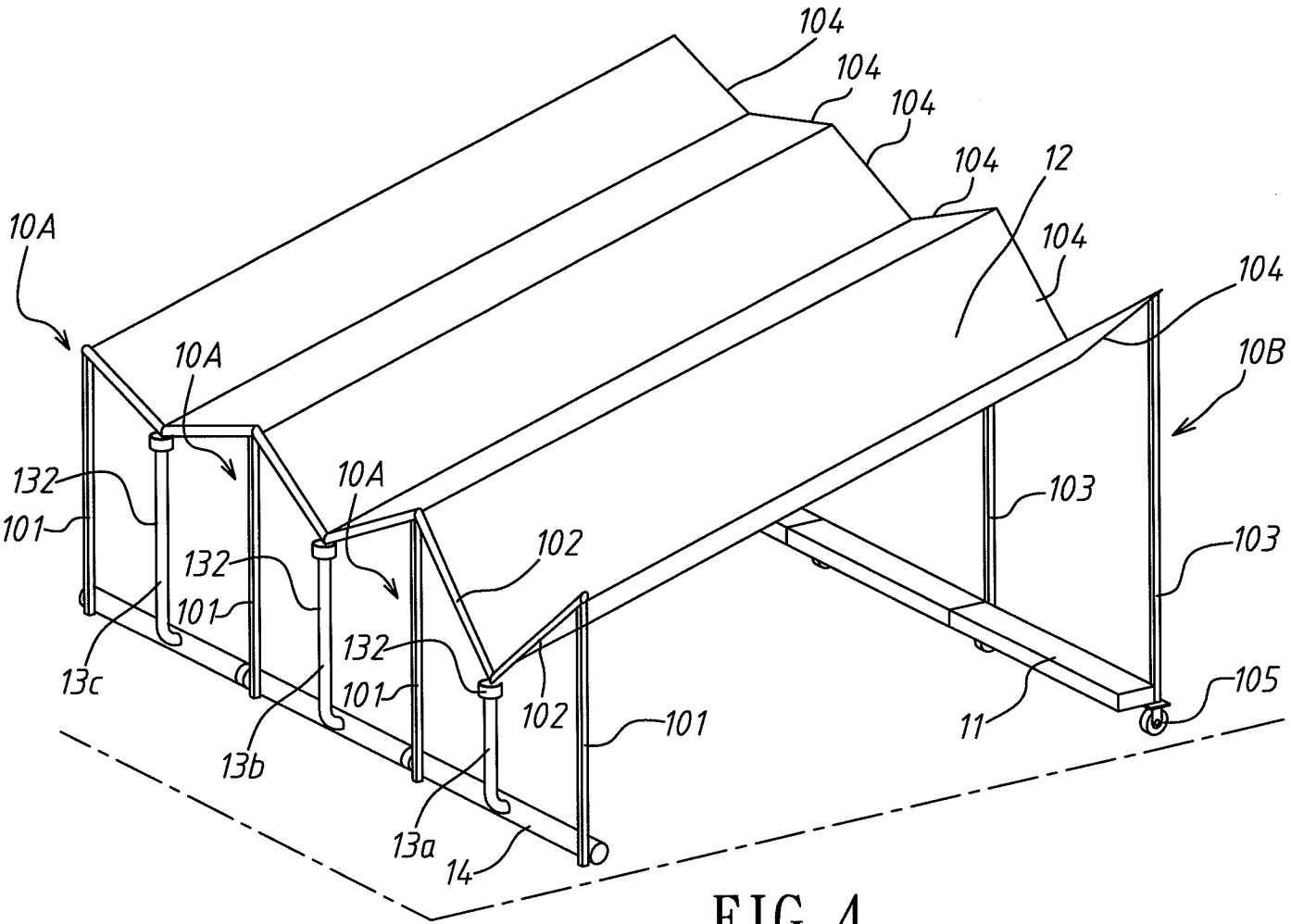
FIG. 4 is a diagram of the architecture of a canopy in accordance with another embodiment of the invention.

According to another embodiment for flowing fluid smoothly, a canopy is similar to above mentioned embodiment. The length of the drains 13*a*, 13*b*, 13*c* are sequentially decreased, in this example, the frame of FIG. 4 in the depicted embodiment showing multiple canopies arranged for larger sheltering. The length of the drain 13*c* is shorter than the drain 13*b*, and the drain 13*b* is shorter than the drain 13*a*. In this manner, the underneath guiding tube 14 with proper slope is able to guide fluid from the drain 13*c* to the drain 13*a* due to gravity.

As various embodiments above-mentioned of the present invention, the waterproof sheet may be made of any suitable waterproof fabric material such as polyester, polyethylene, nylon or plastic materials. The shelter segment can be configured to any shapes of square, triangle, rectangle or other appropriate polygon. Further, numbers of the shelters of the canopies can be arranged, the coverage of the canopy in accordance with embodiments of the present invention can be extended to any desired size.

While the exemplary embodiments have been described in connection with a number of embodiments and implementations, the exemplary embodiments are not so limited but cover various obvious modifications and equivalent arrangements, which fall within the purview of the appended claims. Although features of the exemplary embodiments are expressed in certain combinations among the claims, it is contemplated that these features can be arranged in any combination and order.

What is claimed is:

1. A collapsible canopy comprising:

a frame having a stationary side being fixed to ground, wherein the stationary side of the frame comprises:

two rods, each rod having a bottom and a top, and the bottoms of rods being fixed to ground; and two valley bars being connected to each other and being supported by the corresponding rods and each valley bar having a upper end and a lower end, wherein the upper end of the valley bar being connected to the top of the rod, and the lower end of the valley bar being connected to the other lower end of the other valley bar; and a movable side being opposite corresponded to the stationary side and being configured to move forward and backward in a predetermined path, which expands a coverage of the collapsible canopy, wherein the movable side of the frame comprises:

two rods being detachable from ground and each rod being connected to a mobile mechanism correspondingly; and two valley bars being connected to each other, being supported by the rods of the movable side of the frame and each valley bar having a lower end and an upper end, wherein the upper end of the valley bar is connected to a top of the corresponding rod of the movable side, and the lower end of the valley bar is connected to the other lower end of the valley bar of the movable side;

a propulsive mechanism driving the movable side to expand the frame; and a shelter being expandable and collapsible connected to the frame, wherein the shelter forms a collective area to provide sheltering from exterior weather conditions and guides fluid out when the shelter is expanded and driven by the movable side of the frame, wherein the shelter is formed by two segments and each segment comprises:

a first edge being coupled to and supported by one of the valley bar of the stationary side of the frame;

a rear edge is connected to one of the valley bar of the movable side of the frame;

a first side edge; and a second side edge being connected to the second side edge of the adjacent segment; and wherein the two segments of the shelter form two upper portions and a lower portion, wherein the lower portion is formed as the second side edges of two connected segments sank toward ground.

2. The collapsible canopy as claimed in claim 1, wherein the propulsive mechanism is mounted on the movable side connected to the mobile mechanism, which is triggered by a user and drives the mobile mechanism.

3. The collapsible canopy as claimed in claim 2, wherein the mobile mechanism is driven by a manually-operated module or a motorized module.

4. The collapsible canopy as claimed in claim 1, wherein connections of the first edge, the rear edge, the first side edge and the second side edge is implemented by a connecting assembly.

5. The collapsible canopy as claimed in claim 4, wherein the connecting assembly is a zipper, a Velcro or a hanger.

6. The collapsible canopy as claimed in claim 1, wherein the predetermined path is a slide assembly integrated with the mobile mechanism, the slide assembly is connected to the corresponding rods between the stationary side and the movable side.

7. The collapsible canopy as claimed in claim 1 further comprising a battery module providing power to the propulsive mechanism, wherein the segments of the shelter is a solar panel that charges the battery module by converting sunlight to electricity.

8. The collapsible canopy as claimed in claim 1, further comprising a drain disposed under a side of two connected second side edges where the fluid is flowing out.

9. The collapsible canopy as claimed in claim 8, wherein the drain comprises a tube having an inlet and an outlet, which guides fluid into a guiding tube for collecting fluid to an external water container; and a flange being fastened to the inlet of the tube.

10. The collapsible canopy as claimed in claim 9, wherein the drain further comprises a strainer being disposed between the inlet of the tube and flange, and being used to filter the fallen leaves and dusts.

11. The collapsible canopy as claimed in claim 1, wherein height of the movable side of the frame is higher than height of the stationary side.

12. The collapsible canopy as claimed in claim 1, wherein the shelter is a waterproof sheet and is made of waterproof fabric material selected from a group consisting of polyester, polyethylene, nylon or plastic materials.

* * * * *